US006580209B2

(12) United States Patent
Murakami

(10) Patent No.: US 6,580,209 B2
(45) Date of Patent: Jun. 17, 2003

(54) GLASS FUNNEL FOR A CATHODE RAY TUBE HAVING OUTWARDLY PROTRUDING PORTION SURROUNDING THE YOKE

(75) Inventor: Toshihide Murakami, Funabashi (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 09/945,689

(22) Filed: Sep. 5, 2001

(65) Prior Publication Data

US 2003/0090194 A1 May 15, 2003

(51) Int. Cl.[7] ..... H01J 29/86

(52) U.S. Cl. ..... 313/477 R; 313/407; 313/408; 220/2.1 A; 220/2.1 R; 220/2.3 A; 220/2.3 R; 445/24; 445/25

(58) Field of Search ..... 313/477 R, 407, 313/408, 430–434, 478; 445/24, 25; 220/2.1 A, 2.1 R, 2.3 A, 2.3 R

(56) References Cited

U.S. PATENT DOCUMENTS 6,392,336 B1 * 5/2002 Sugawara et al. ..... 313/477 R

* cited by examiner

*Primary Examiner*—Ashok Patel
*Assistant Examiner*—Sikha Roy
(74) *Attorney, Agent, or Firm*—Oblon, Spivak, McClelland, Maier & Neustadt, P.C.

(57) ABSTRACT

A glass funnel for a cathode ray tube in which the asymmetry in shape of the body portion is relaxed to reduce stress whereby an increase of the weight can be suppressed and the dimension in a direction of the depth can be shortened.

A portion of the body portion, contiguous to the yoke portion is protruded outwardly to reduce stress, and a front end of the yoke portion is close to an open end portion of the body portion without increasing the wall thickness of the body portion so that the dimension in a direction of the depth of the glass funnel is reduced to shorter the dimension in a direction of the depth of the cathode ray tube.

12 Claims, 2 Drawing Sheets

GLASS FUNNEL FOR A CATHODE RAY TUBE HAVING OUTWARDLY PROTRUDING PORTION SURROUNDING THE YOKE

BACKGROUND OF THE INVENTION

1. Field of the Invention

The present invention relates to a glass funnel for a cathode ray tube used mainly for receiving television broadcast signals and for industrial equipments, and a cathode ray tube using such glass funnel.

2. Discussion of Background

A cathode ray tube has a glass bulb which comprises basically a glass panel 1 for displaying images and a glass funnel 2 having a neck portion 5 housing an electron gun 6. The major components of the glass funnel 2 are a yoke portion 4 for mounting a deflection coil 7 and a body portion 3 which is continuous to the yoke portion and extends toward an open end portion for sealing the glass panel 1.

In FIG. 3, reference numeral 16 designates a reinforcing band for maintaining a strength to impact, numeral 10 designates a sealing portion for sealing the glass panel 1 to the glass funnel 2 with a solder glass or the like, numeral 12 designates a fluorescent film emitting fluorescence by the irradiation of electron beams 11, numeral 13 designates an aluminum film for reflecting forwardly light emitted in the fluorescent film, numeral 14 designates a shadow mask for determining the position of irradiated electron beams on the fluorescent film, numeral 15 designates a stud pin for fixing the shadow mask 14 to an inner surface of the glass panel 1, and numeral 17 designates an anode button which is conductive to the outside as the ground so that a high electric potential on the shadow mask 14 by the irradiation of electron beams is prevented.

A symbol A denotes the tube axis connecting the center axis of the neck portion 5 to the center of the glass panel 1, and a symbol B denotes an imaginary reference line indicating the center of deflection. A screen formed in the inner surface of the glass panel by the fluorescent film 12 has a substantially rectangular shape having the tube axis as the central point, and the screen is defined by 4 sides substantially parallel to a long axis and a short axis which cross perpendicular to the tube axis.

The inside of the cathode ray tube is maintained under a high vacuum condition because an image is displayed by irradiating electron beams in the glass bulb. Since the glass bulb has an asymmetric structure unlike a spherical shape and resists a differential pressure of 1 atmospheric pressure between the inside and the outside of it, there is always a high deformation energy in the glass bulb, and it is always in an unstable state of deformation. When a crack is generated in the glass bulb for the cathode ray tube in such state, the crack will extend to release the high deformation energy in the glass bulb to thereby cause destruction. Further, in such a condition that a high stress is applied to an outer surface of the glass bulb, a delayed destruction may be resulted due to the function of moisture in the atmosphere, whereby reliability of the glass bulb decreases.

On the other hand, various kinds of image displaying device other than the cathode ray tube have been proposed in recent years. In comparison with the cathode ray tube with the proposed display devices, the dimension in a direction of the depth is taken as a large drawback. Therefore, an attempt of shortening the dimension in a direction of the depth of the cathode ray tubes has been made. Since the dimension in the depth of the cathode ray tubes is mainly determined by the length of the glass funnel in a direction of the tube axis as understood from FIG. 3, it is effective to reduce the length in order to shorten the depth of the cathode ray tube. FIG. 4 shows a conventional technique proposed to solve this problem wherein the shortening of the depth can be achieved by making the angle of the body portion wide.

However, when the angle of the body portion of glass funnel is made wide as described above, the cathode ray tube becomes flat and has a shape remoter from a spherical shape. Accordingly, the asymmetry in shape of the cathode ray tube is enhanced, and the stress generated in the outer surface also increases. An increased stress will cause a deterioration of safety, if a destruction occurs, and a deterioration of reliability due to a delayed destruction. Although an increase of the stress can be prevented or reduced by increasing the wall thickness of glass as shown in FIG. 4, an increased wall thickness will cause a large increase of the weight, which is another weak point of the cathode ray tube. If the size of a cathode ray tube is increased, the glass bulb becomes inevitably heavy. Accordingly, an increase of the weight due to the wall thickness is a very large problem.

SUMMARY OF THE INVENTION

It is an object of the present invention to provide a glass funnel for a cathode ray tube, preventing an increase of stress and reducing the length in a direction of the tube axis by designing well the shape of the body portion, without using a technique of preventing an increase of stress generated in the glass funnel by increasing simply the wall thickness of the body portion.

Further, it is an object of the present invention to provide a cathode ray tube which is safe, light in weight, highly reliable and has a reduced dimension in a direction of the depth and which reduces an increase of asymmetry as a vacuumed envelope and prevents an increase of stress, by assembling the above-mentioned glass funnel.

In accordance with the present invention, there is provided a glass funnel for a cathode ray tube which comprises a body portion having a substantially rectangular open end portion at its one end, a yoke portion formed contiguous to the other end of the body portion and a neck portion connected to the other end of the yoke portion, on an outer side of which a deflection means for deflecting electron beams emitted from an electron gun housed in the neck portion is mounted, wherein a portion of the body portion in the vicinity of the yoke portion is protruded outwardly so that a front end of the yoke portion contiguous to the body portion is located at a position at a side of the open end portion with respect to the portion of the body portion, which is the remotest from the open end portion, and a recessed portion is formed around the yoke portion by the outwardly protruded body portion.

Further, in accordance with the present invention, there is provided a glass funnel for a cathode ray tube which comprises a body portion having a substantially rectangular open end portion at its one end, a yoke portion formed contiguous to the other end of the body portion and a neck portion connected to the other end of the yoke portion, on an outer side of which a deflection means for deflecting electron beams emitted from an electron gun housed in the neck portion is mounted, wherein at least a portion of the yoke portion is recessed to a side of the open end portion with respect to the body portion, and an annularly recessed portion is formed between the yoke portion and the body portion in a circumferential portion of the yoke portion.

DETAILED DESCRIPTION OF THE PREFERRED EMBODIMENTS

The present invention is to reduce an increase of asymmetry resulted from the shortening of the dimension in a direction of the depth of the glass funnel to make it thin, by protruding outwardly a portion of the body portion in the vicinity of the yoke portion of the glass funnel, whereby an effect of preventing an increase of stress is obtainable. In more detail, the present invention is featurized by protruding outwardly a portion of the body portion in the vicinity of the yoke portion so that a front end of the yoke portion contiguous to the body portion is located at a position at a side of the open end portion with respect to the portion of the body portion, which is the remotest from the open end portion. Around the yoke portion, the recessed portion is formed by the outwardly protruded body portion, and a deflection means such as a deflection coil can be positioned in the recessed portion.

In a usually used cathode ray tube, the neck portion is at the position remotest from the open end portion of the glass funnel; the yoke portion is formed in front of the neck portion, and the body portion is formed integrally with the front end of the yoke portion, whereby an envelope device is constituted. In order to shorten the dimension in length in a direction of the tube axis of the glass funnel, it is necessary to form the neck portion and the yoke portion close to the open end portion as possible. However, when the yoke portion is brought closer to the open end portion, the body portion becomes thin and its assymmetoricity increases, as described before. Therefore, the stress in the body portion or a panel sealing portion which is weak in strength increases.

From a viewpoint of preventing an increase of stress, it is desirable to bring the yoke portion and the neck portion closer to the open end portion without shortening the body portion which functions as a vacuumed envelope device. A circumferential area around the neck portion and the yoke portion is an unnecessary space other than a portion on which a deflection means such as a deflection coil or the like is mounted. In the present invention, therefore, a portion of the body portion is protruded outwardly along a circumferential portion of the yoke portion by utilizing this space. Accordingly, a glass funnel having a reduced distance between the neck portion or the yoke portion and the open end portion, i.e., a shortened length in a direction of the tube axis can be obtained without making the envelope device thin, hence, without increasing the wall thickness of the body portion.

Figure 3:
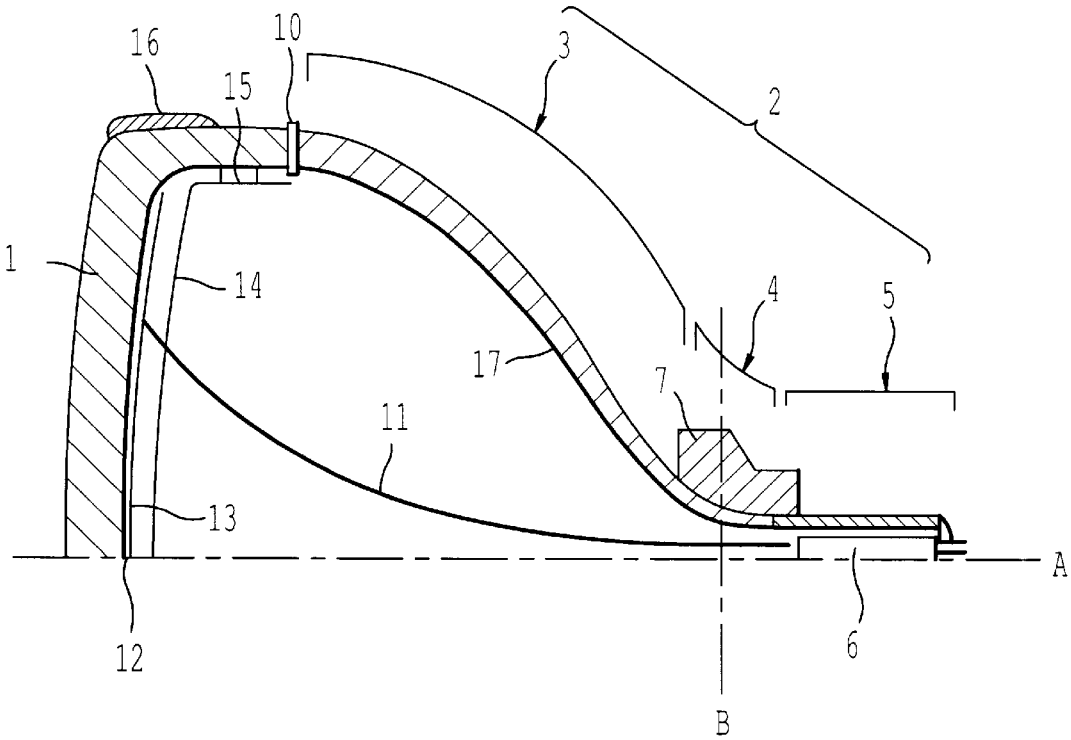
FIG. 3 (PRIOR ART)
FIG. 3 is a partially cross-sectional view of a conventional cathode ray tube.
Figure 4:
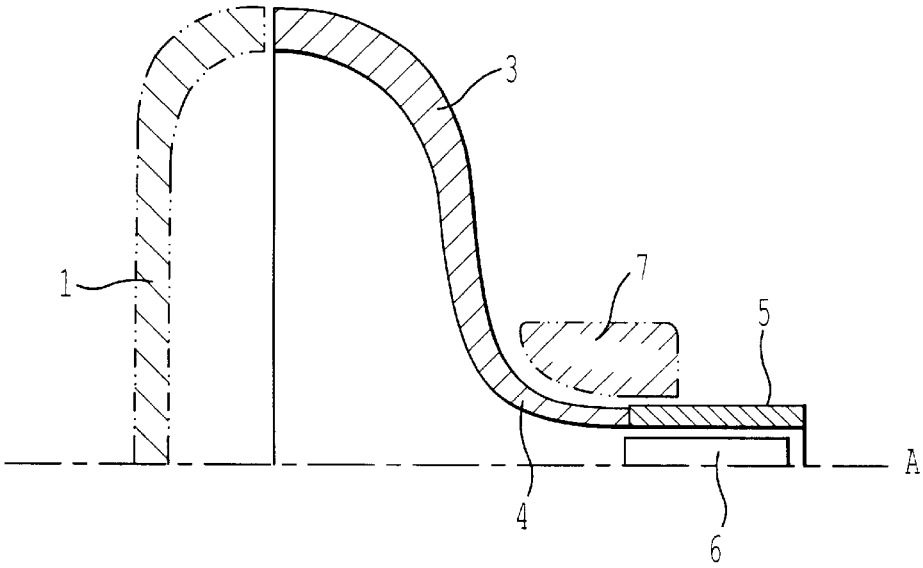
FIG. 4 (PRIOR ART)
FIG. 4 is a partially cross-sectional view of a conventional glass funnel.

When this way of thinking of the present invention is applied to the ordinary glass funnel as shown in FIG. 3, the following advantages can be achieved. Namely, at least a portion of the yoke portion is recessed to a side of the open end portion with respect to the body portion to bring the yoke portion closer to the open end portion whereby the dimension in the depth of the glass funnel can be shortened, and at the same time, a structure of the protrusion of the body portion obtainable from recessing at least a portion of the yoke portion reduces stress generated when a cathode ray tube is formed by assembling the glass funnel, and a predetermined strength is obtainable without increasing, in particular, the wall thickness of the body portion.

In the following, the glass funnel for a cathode ray tube of the present invention will be described in detail with reference to FIG. 1.

Figure 1:
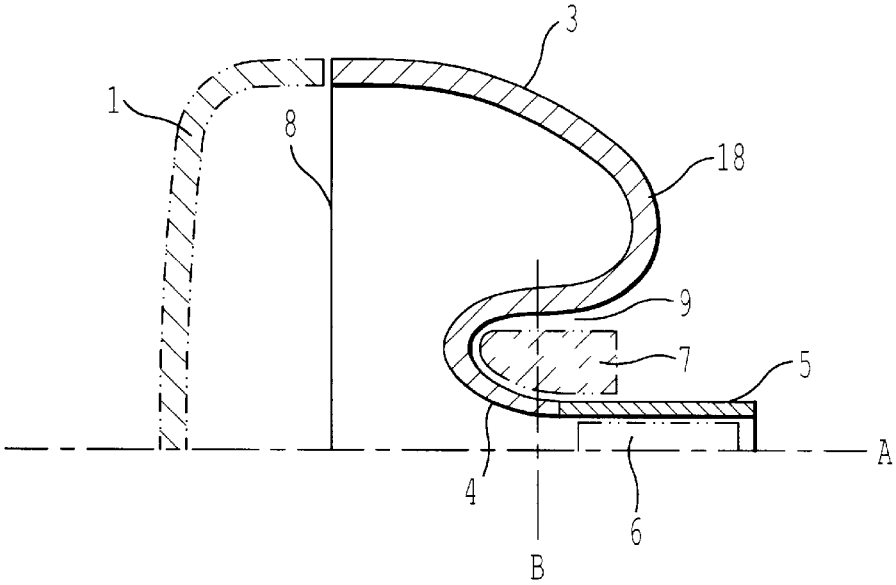
FIG. 1 is a partially cross-sectional view of the glass funnel according to an embodiment of the present invention.
Figure 2:
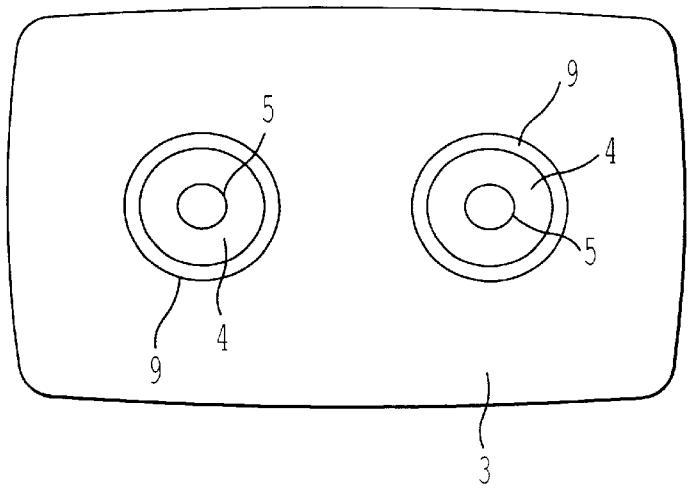
FIG. 2 is a plan view of the glass funnel according to another embodiment of the present invention.

FIG. 1 is a side view in cross section of a part of the glass funnel for a cathode ray tube. In FIG. 1, a glass panel 1 and a deflection coil 7 are indicated by an imaginary line. The basic structure of the glass funnel is the same as that of the conventional one comprises a body portion 3, a yoke portion 4 and a neck portion 5 wherein an end of the body portion 3 as the main component of the glass funnel provides an open end portion 8 to which the glass panel 1 is attached sealingly. The shape of the open end portion 8 is substantially the same as an outer configuration of the glass panel 1, and has a substantially rectangular shape.

In FIG. 1, a portion of the body portion in the vicinity of the yoke portion 4 is protruded outwardly to form a protrusion 18 unlike the conventional glass funnel in that the body portion 3 spreads monotonously outside to form a funnel-like shape. With such structure, the top of the protrusion 18 in the body portion 3 is at a position remotest from the open end portion 8, and a front end (at a side of the glass panel 1) of the yoke portion contiguous to the body portion is located at a position at a side of the open end portion with respect to the top of the protrusion 18 in the body portion 3. In the conventional glass funnel, since the body portion 3 spreads monotonously outside as described above, the portion of the body portion, which is the remotest from the open end portion 8, is the junction (the boundary) to the yoke portion. In this connection, the glass funnel of the present invention is clearly distinguishable from the conventional glass funnel.

The protrusion 18 of the body portion 3 is formed so that a space capable of accommodating the deflection coil 7 can be assured in a circumferential portion of the yoke portion 4. An annularly recessed portion 9 can be formed between the yoke portion and the body portion in a circumferential portion of the yoke portion 4 by protruding at least a portion of the body portion 3 over the entire circumference of the yoke portion 4. Usually, the body portion 3 is protruded substantially uniformly over the entire circumference of the yoke portion 4. However, the magnitude of protrusion in the circumference of the yoke portion 4 may be changed depending on directions. For instance, a portion of the body portion in which a further reduction of stress is desired may be protruded larger than the other portion of the body portion.

Further, the depth of the recessed portion 9 (which corresponds to the length in a direction of the tube axis A) can be changed as desired depending on a degree of protrusion of the body portion 3 or a degree of recession of the yoke portion 4 with respect to the body portion 3. Accordingly, a part or the entirety of the deflection coil 7 mounted on an outer side of the yoke portion can be accommodated in the recessed portion.

By forming the body portion 3 to have the above-mentioned shape, the asymmetry in shape of the body portion as a part of the vacuumed envelope device can be relaxed, and an increase of stress does not cause. Further, since the reduction of stress is unnecessary, it is unnecessary to increase the wall thickness. Accordingly, a predetermined strength can be obtained without increasing substantially the weight although there is a slight increase of the weight by the portion protruded. Further, the dimension in the depth of the glass funnel (the length in a direction of the tube axis A) can be shortened, which is essential to shorten the dimension in the depth of a cathode ray tube as the object of the present invention. Specifically, the distance from the open end portion 8 can be reduced by the dimension obtained by bringing the yoke portion 4 and the neck portion 5 closer to the open end portion 8.

In considering the effect of suppressing an increase of stress to be significant, it is desirable that a portion of the body portion 3 is protruded backward in the entire circumference of the yoke portion. However, it is possible to protrude a portion of the yoke portion only in a specified direction while a portion of the yoke portion in other directions is not protruded, from the viewpoint of the deflection coil to be mounted, the increase of the weight, the reduction of stress and so on. These conditions can be determined depending on requirements in designing.

In the above, description has been made as to a typical glass funnel in which a single yoke portion is provided in the body portion. However, the present invention is applicable to a glass funnel in which a plurality of yoke portions, e.g., two yoke portions 4,4 are provided in parallel in the body portion 3.

In the present invention, even when the glass funnel has such a shape that a portion of the body portion 3 is protruded backward with respect to the actual front end of the yoke portion 4 so that the yoke portion is brought closer to the open end portion to thereby reduce the depth of the glass funnel, the asymmetry in shape of the glass funnel as a part of an envelope device can be relaxed, and therefore, the increase of stress can be suppressed.

Now, the present invention will be described in further detail with reference to Examples and Comparative Examples using Table 1. However, it should be understood that the present invention is by no means restricted to such specific examples.

Glass panels (hereinbelow referred to simply as panels) used in these Examples were such ones, made of Asahi Glass Company, Limited, for an ordinary cathode ray tube, as shown in FIG. 3, for 36 type television in which the aspect ratio was 16:9, the outermost diameter of panel was 921.6 mm, the height of panel glass was 115.0 mm, the wall thickness at the center of panel was 28.5 mm, the radius of curvature of outer surface of the panel was 10000 cm and the diagonal diameter of the useful screen was 86 cm. Each cathode ray tube was prepared by assembling the panel and a glass funnel, and stresses produced in the cathode ray tubes were measured. The physical properties of glass for glass bulbs are shown in Table 2.

EXAMPLE 1

(Example)

The glass funnel of this example was the same as the one of Example 3 (Comparative Example) as the conventional glass funnel in which the dimension in the depth was not shortened, except that the depth was shortened by 143 mm by shortening the distance between the yoke portion and the sealing portion (the open end portion), and a portion of the body portion in the vicinity of the yoke portion was protruded backward by 93 mm with respect to a front end of the yoke portion. Although it was necessary that the wall thickness of the body portion was 1.5 mm thicker than that of Example 3, the increase of the weight was only 2.5 kg, and there was no increase in stress value.

EXAMPLE 2

(Example)

The glass funnel of this example was same as Example 1 except that the height of the body portion was increased to be 128 mm. The depth was shortened by 143 mm in the same manner as Example 1. By increasing the height of protrusion, the increase of the wall thickness of the body portion could be suppressed with the result that the increase of the weight was only 1.0 kg, and there was no increase in stress value.

EXAMPLE 3

(Comparative Example)

The glass funnel of this example was the conventional one as shown in FIG. 3 in which the dimension in the depth was not shortened. Accordingly, the cathode ray tube using such glass funnel did not have the shortened depth.

EXAMPLE 4

(Comparative Example)

The glass funnel of this example was prepared so that the dimension in the depth was shortened by 143 mm commensurate with the shortened depth in Example 1, and the weight was substantially the same as that of Example 3. The weight of the glass funnel attached with the panel was 55 kg. The maximum stress generated in the body portion of the glass funnel indicated a high stress value as 40 MPa which might cause destruction in several days even in a standstill condition.

EXAMPLE 5

(Comparative Example)

The glass funnel of this example was prepared so that the dimension in the depth was shortened by 143 mm commensurate with the shortened depth in Example 1, and the maximum stress value produced in the body portion assembled into a cathode ray tube was substantially the same as that of Example 3. Although the stress was substantially same as that of Example 3, the wall thickness of the body portion had to be 30 mm, with the result that the weight was 70 kg in an increase of 30%. Accordingly, a very heavy cathode ray tube was formed.

TABLE 1

| Item | Ex. 1 | Ex. 2 | Ex. 3 | Ex. 4 | Ex. 5 |
|---|---|---|---|---|---|
| From the open end portion to the front end of the yoke portion (mm) | 82.0 | 82.0 | 225.0 | 82.0 | 82.0 |
| From the front end of the yoke portion to the rear end of the body portion (mm) | 93.0 | 128.0 | — | — | — |
| The length of the yoke portion (mm) | 65.0 | 65.0 | 65.0 | 65.0 | 65.0 |
| The length of the neck portion (mm) | 133.0 | 133.0 | 133.0 | 133.0 | 133.0 |
| Entire length of the glass funnel (mm) | 280.0 | 280.0 | 423.0 | 280.0 | 280.0 |
| Entire length of the bulb (mm) | 395.0 | 395.0 | 538.0 | 395.0 | 395.0 |
| Wall thickness of the body portion (50 mm from the open end portion on a short axis) (mm) | 10.0 | 9.0 | 8.5 | 10.0 | 30.0 |
| Wall thickness of the sealing portion (mm) | 14.0 | 13.0 | 14.0 | 14.0 | 30.0 |

TABLE 1-continued

| Item | Ex. 1 | Ex. 2 | Ex. 3 | Ex. 4 | Ex. 5 |
|---|---|---|---|---|---|
| Weight of the glass bulb (kg) | 57.1 | 55.6 | 54.6 | 55.0 | 70.0 |
| Maximum stress in the panel portion (on a short axis) (MPa) | 11 | 11 | 11 | 12 | 11 |
| Maximum stress in the body portion (on a short axis) (MPa) | 7 | 7 | 6 | 40 | 8 |
| Maximum stress in the sealing portion (on a short axis) (MPa) | 7 | 7 | 7 | 16 | 7 |

TABLE 2

| | Panel glass | Funnel glass | Neck glass |
|---|---|---|---|
| Density (g/cm$^3$) | 2.79 | 3.00 | 3.29 |
| Young's modulus (kgf/cm$^2$) | $7.5 \times 10^5$ | $6.9 \times 10^5$ | $6.2 \times 10^5$ |
| Poisson's ratio | 0.21 | 0.21 | 0.23 |

In the present invention, a very unique technique that a portion of the body portion of the glass funnel is protruded backward with respect to a front end (a reference line) of the yoke portion is used, whereby the asymmetry in shape of the body portion of the glass funnel as a vacuumed envelope device can be relaxed to reduce stress. Accordingly, a reduced dimension in the depth of the glass funnel or the cathode ray tube prepared by using such glass funnel can easily be realized.

Further, the cathode ray tube which can suppress an increase of stress as well as an increase of the weight and which is safe and highly reliable, can be realized by the present invention.

The entire disclosure of Japanese Patent Application No. 11-47217 filed on Feb. 24, 1999 including specification, claims, drawings and summary are incorporated herein by reference in its entirety.

What is claimed is:

1. A glass funnel for a cathode ray tube which comprises a body portion having a substantially rectangular open end portion at its one end, a yoke portion formed contiguous to the other end of the body portion and a neck portion connected to the other end of the yoke portion, on an outer side of which a deflection means for deflecting electron beams emitted from an electron gun housed in the neck portion is mounted, wherein a portion of the body portion in the vicinity of the yoke portion is protruded outwardly so that a front end of the yoke portion contiguous to the body portion is located at a position at a side of the open end portion with respect to the portion of the body portion, which is the remotest from the open end portion, and a recessed portion is formed around the yoke portion by the outwardly protruded body portion.

2. The glass funnel for a cathode ray tube according to claim 1, wherein the recessed portion formed around the yoke portion has a space capable of accommodating a part or the entirety of the deflection means.

3. The glass funnel for a cathode ray tube according to claim 1, wherein a plurality of yoke portions are formed in the body portion.

4. A glass funnel for a cathode ray tube which comprises a body portion having a substantially rectangular open end portion at its one end, a yoke portion formed contiguous to the other end of the body portion and a neck portion connected to the other end of the yoke portion, on an outer side of which a deflection means for deflecting electron beams emitted from an electron gun housed in the neck portion is mounted, wherein at least a portion of the yoke portion is recessed to a side of the open end portion with respect to the body portion, and an annularly recessed portion is formed between the yoke portion and the body portion in a circumferential portion of the yoke portion.

5. The glass funnel for a cathode ray tube according to claim 4, wherein the annularly recessed portion has a space capable of accommodating a part or the entirety of a deflection means.

6. The glass funnel for a cathode ray tube according to claim 4, wherein a plurality of yoke portions are formed in the body portion.

7. A cathode ray tube having the glass funnel for a cathode ray tube described in claim 1.

8. The cathode ray tube having the glass funnel for a cathode ray tube described in claim 2.

9. The cathode ray tube having the glass funnel for a cathode ray tube described in claim 3.

10. A cathode ray tube having the glass funnel for a cathode ray tube described in claim 4.

11. The cathode ray tube having the glass funnel for a cathode ray tube described in claim 5.

12. The cathode ray tube having the glass funnel for a cathode ray tube described in claim 6.

* * * * *